US005845616A

United States Patent [19]

Schwarzenthal et al.

[11] Patent Number: 5,845,616

[45] Date of Patent: Dec. 8, 1998

[54] CYLINDER HEAD ARRANGEMENT OF AN INTERNAL-COMBUSTION ENGINE

[75] Inventors: Dietmar Schwarzenthal, Ditzingen; Hanns-Ulrich Hautsch, Wurmberg; Tito Herre, Sersheim, all of Germany

[73] Assignee: Dr. Ing. h.c.F. Porsche AG, Germany

[21] Appl. No.: 853,345

[22] Filed: May 8, 1997

[30] Foreign Application Priority Data

May 8, 1996 [DE] Germany ..... 196 18 401.0

[51] Int. Cl.[6] ..... F01M 9/10; F01M 11/02; F02F 1/24

[52] U.S. Cl. ..... 123/90.33; 123/90.37; 123/90.38; 123/193.5; 123/196 M

[58] Field of Search ..... 123/90.15, 90.16, 123/90.17, 90.33, 90.37, 90.38, 193.5, 193.3, 196 R, 196 M; 184/6.5, 6.9

[56] References Cited

FOREIGN PATENT DOCUMENTS

| | | |
|---|---|---|
| 0 318 303 A1 | 11/1988 | European Pat. Off. . |
| 2 552 820 | 4/1985 | France . |
| 4421057 | 9/1995 | Germany . |
| 44 35 299 A1 | 4/1996 | Germany . |

*Primary Examiner*—Weilun Lo

*Attorney, Agent, or Firm*—Evenson, McKeown, Edwards & Lenahan, P.L.L.C.

[57] ABSTRACT

The cylinder head arrangement of an internal-combustion engine consists of at least two housing components which are arranged on one another in a common flange plane. Adjacent this flange plane, indentations extend in the respective flange surfaces and may, for example, be cast in. In the flange plane, the two flange surfaces are separated from one another by an inserted seal so that at least two mutually separated duct sections are formed which are used for the oil supply of the cylinder head arrangement.

20 Claims, 6 Drawing Sheets

CYLINDER HEAD ARRANGEMENT OF AN INTERNAL-COMBUSTION ENGINE

This application claims the priority of German priority document 196 13 401.0, the disclosure of which is expressly incorporated by reference herein.

BACKGROUND AND SUMMARY OF THE INVENTION

The invention relates to a cylinder head arrangement for an internal combustion engine.

German Patent Document DE 44 21 057 C1 indicates a cylinder head arrangement of the generic type, in which a basic housing is screwed onto a cylinder block. The basic housing has raised exterior walls onto which a hood-type cover is placed which also accommodates the upper bearing halves for the camshaft bearing. Within the exterior walls of the basic housing, a bucket tappet housing is arranged inside the basic housing and is used for accommodating and guiding the bucket tappets of the charge cycle valves. In the common flange plane of the bucket tappet housing and the basic housing, an oil guiding duct is constructed which is used for guiding the oil and for supplying the bucket tappets. The bucket tappets can be supplied for the purpose of a lubrication and for acting upon an optionally existing hydraulic valve clearance compensation element.

In view of the increased power requirements, lower fuel consumption and improved emission behavior of contemporary internal-combustion engines, the demands on the cylinder head design and the geometry become increasingly complex. It is important, however, that no compromises be accepted with respect to the weight and the size of cylinder heads, as well as the manufacturing expenditures and manufacturing costs. Particularly for improving the power and the emission behavior, cylinder heads are increasingly provided with four or five valves per cylinder, so that the number of friction surfaces to be supplied with lubricant is increased. At the same time, variable valve timing gears are frequently used to improve the power and the emission behavior; thus, for example, the phase position of the valve timing and/or the valve stroke are variable or switchable. In this case, separate systems are used which, however, are usually hydraulically controllable and must therefore be correspondingly integrated in the oil circulating system of the internal-combustion engine or of the cylinder head.

It is therefore an object of the invention to provide an improved cylinder head arrangement of the above-mentioned type which ensures improved oil guiding within the cylinder head arrangement, capable of supplying a large number of consuming devices and, at the same time, is easy to manufacture. Work-intensive and cost-intensive bores should largely be eliminated.

This object is achieved by the cylinder head arrangement according to the invention, in which two separate ducts are provided in the common flange plane of two housing components. These ducts are separated from one another by an inserted seal so that, without the need for additional bores, different consuming devices within the cylinder head arrangement can be supplied with a pressure medium or lubricant. By such a bifurcation of the oil guide, consuming devices with different pressure requirements and/or volume requirements can be supplied. These ducts of the oil supply of the cylinder head can be produced in a particularly advantageous manner without significant additional expenditures, by casting; during the casting production of the housing component, corresponding indentations are cast into the flange surface.

In a particularly advantageous embodiment, also very high-expenditure duct courses which have no intersections are permitted within the flange plane if passages are formed in the seal through which the individual ducts are connected with one another, and the oil flow is therefore guided in sections in different housing components.

Such an oil guide can be manufactured particularly easily and can be connected with the lubricating oil supply of the overall internal-combustion engine if one of the housing components is a basic housing which has charge cycle ducts and valve guides and is fitted on the cylinder block of the internal-combustion engine. In this case the oil supply to the internal-combustion engine is provided in a manner known per se, by means of ascending bores within the cylinder block which are connected with the oil pump of the internal-combustion engine. By providing the flange plane on the basic housing, a short and relatively direct transition is possible from the cylinder block to this flange plane and the duct sections provided in it.

Other objects, advantages and novel features of the present invention will become apparent from the following detailed description of the invention when considered in conjunction with the accompanying drawings.

DETAILED DESCRIPTION OF THE DRAWINGS

Figure 1:
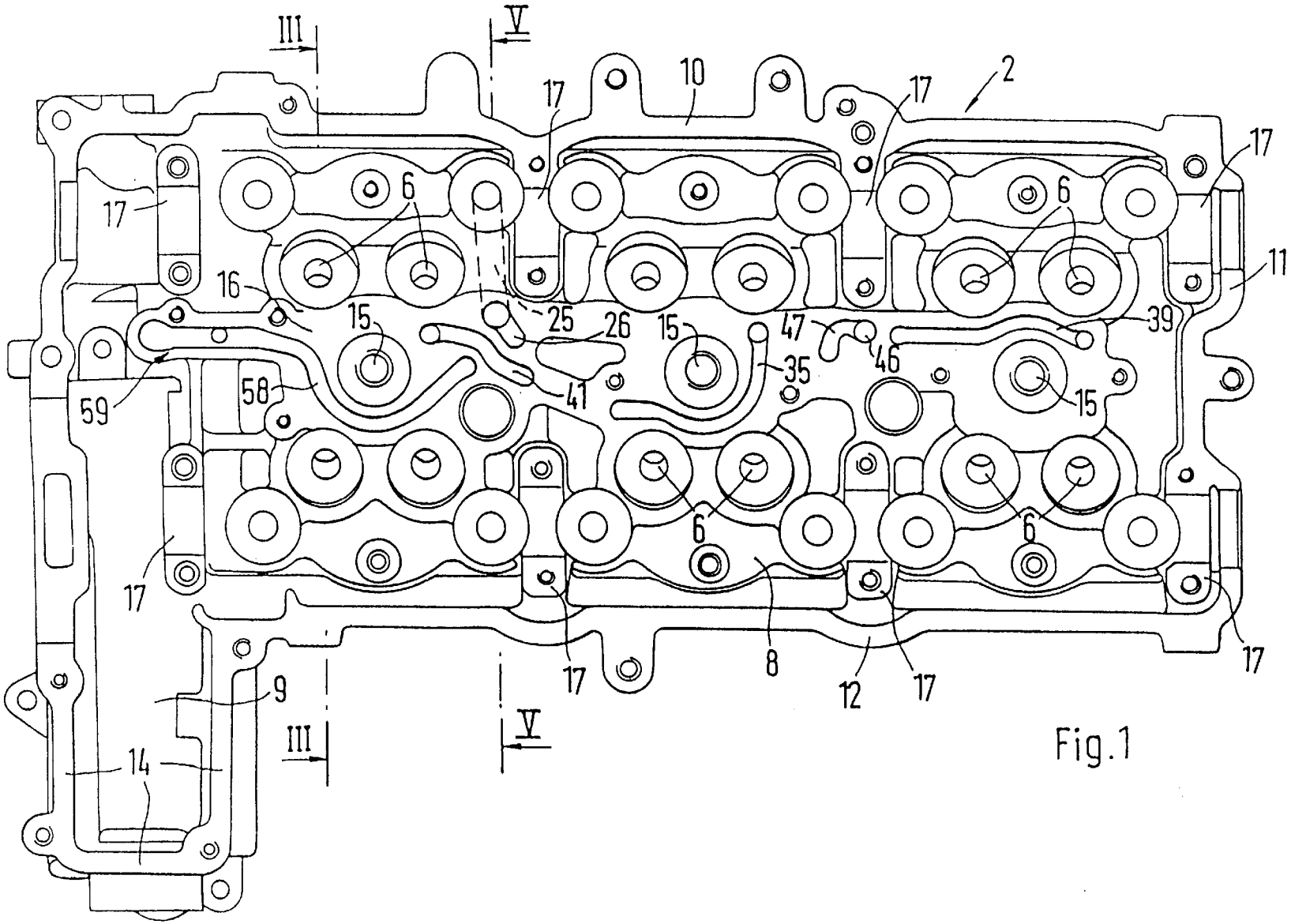
FIG. 1 is a plan view of the opened basic housing of the cylinder head arrangement according to the invention.
Figure 2:
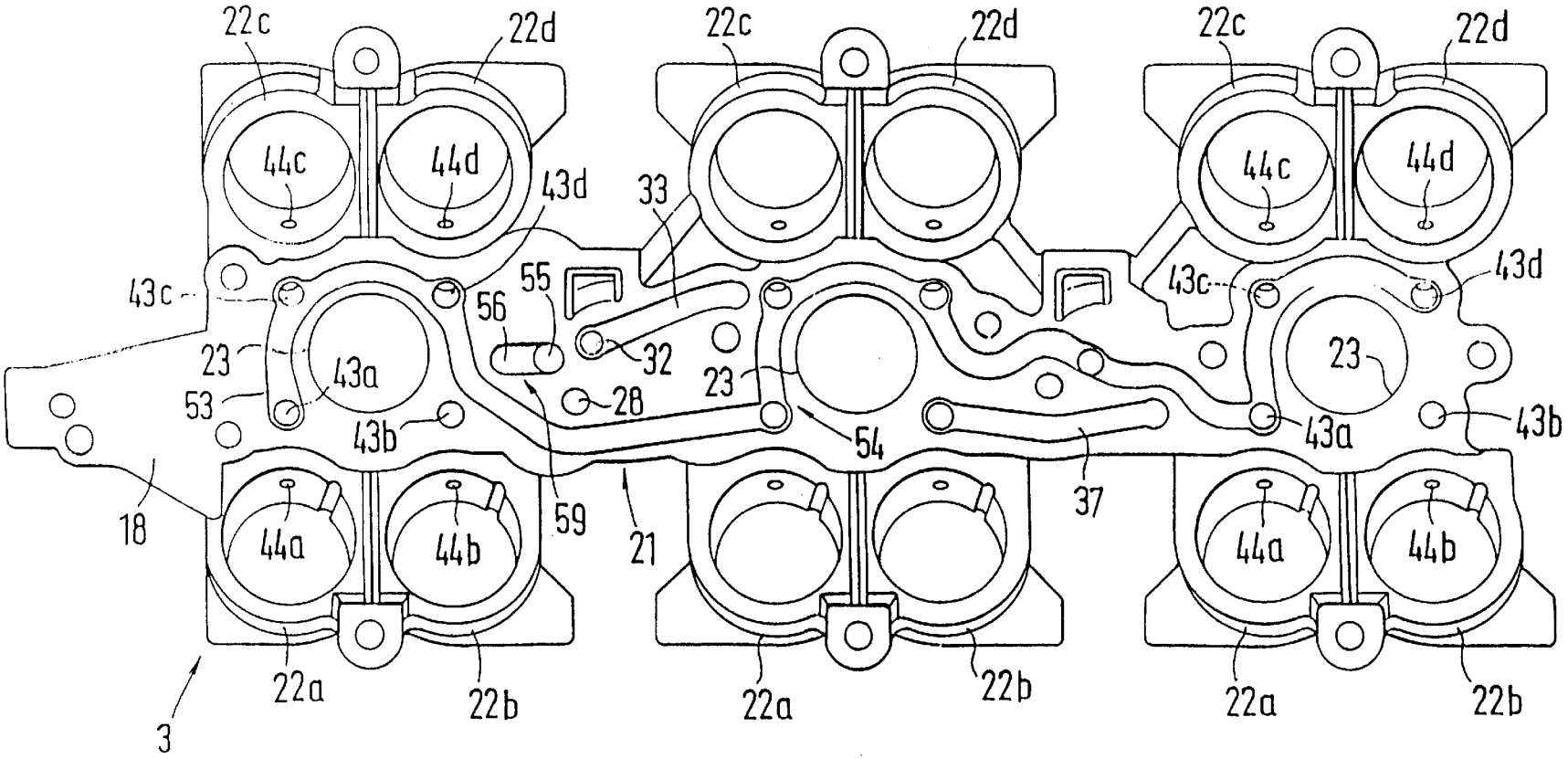
FIG. 2 is a view of the flange surface of the bucket tappet housing facing the basic housing.
Figure 3:
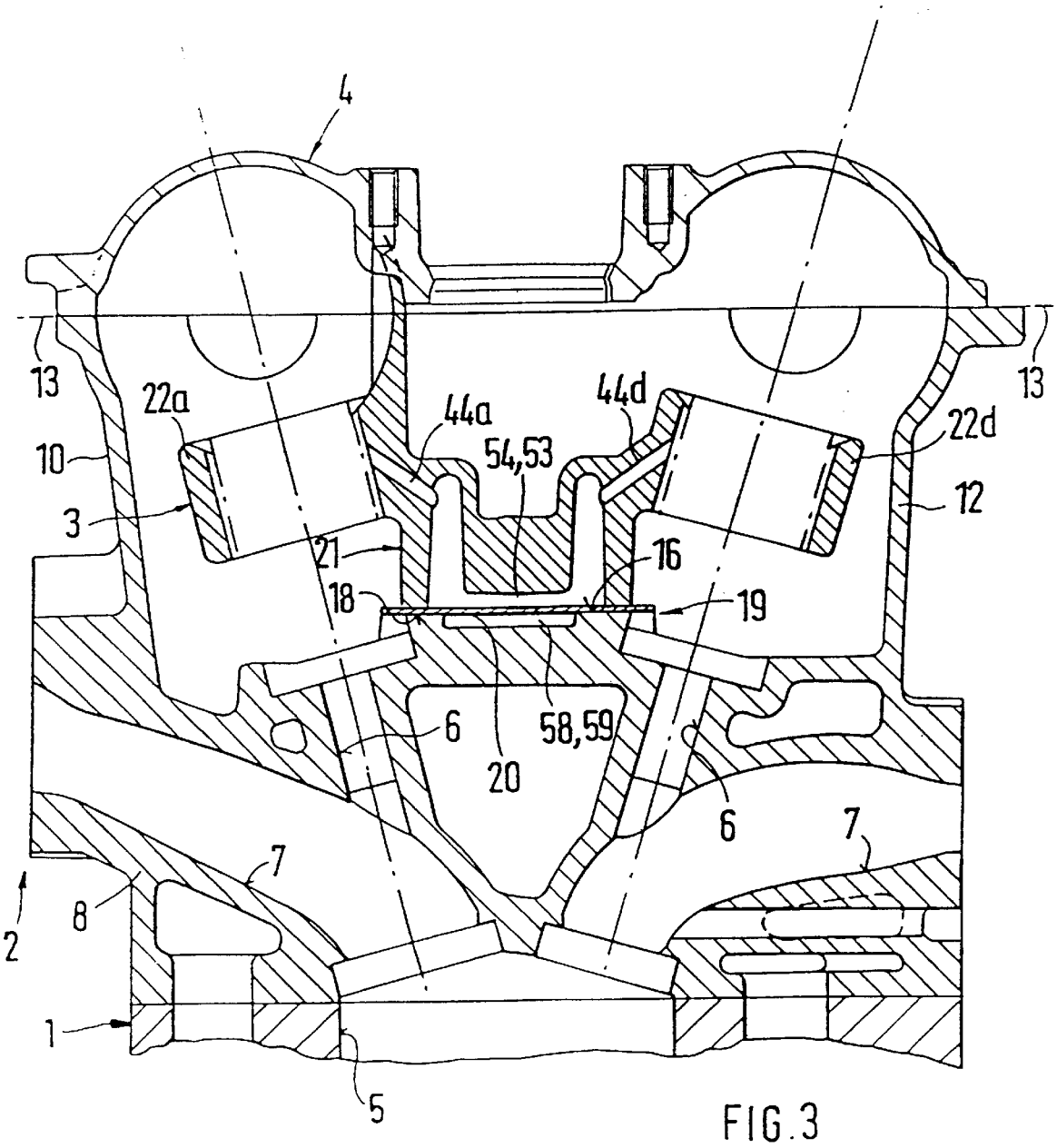
FIG. 3 is a cross-sectional view of the cylinder head arrangement along Line III—III in FIG. 1.

As depicted in the Figures, an internal-combustion engine has a cylinder head arrangement which is fitted onto a cylinder block 1 (FIG. 3) and whose housing is composed of three housing components, specifically a basic housing 2 (FIGS. 1,3), a bucket tappet housing 3 (FIGS. 2,3) and a cylinder head cover 4 (FIG. 3). In this embodiment, the internal-combustion engine is illustrated in the form of a cylinder bank of an opposed cylinder engine having six cylinders, each with four valves, and two overhead camshafts. For this reason, the internal-combustion engine has three cylinder bores 5 (FIG. 3) per cylinder bank. Each of these cylinder bores 5 is controlled by way of four charge cycle valves (two inlet valves, two outlet valves), which are guided in valve guides 6 (FIGS. 1,3—not shown in detail), and corresponding charge cycle ducts 7 (FIG. 3). The charge cycle ducts 7 and valve guides 6 are integrated in a basic block 8 (FIG. 3) of the basic housing 2 to which a timing case 9 is connected on the front side, as depicted in FIG. 1, to accommodate driving devices (not shown) for the camshafts. Exterior walls 10, 11, 12, which rise to a common junction plane 13, extend away from the basic block 8 of the housing 2. The timing case 9 is surrounded by exterior walls 14 which also reach to this junction plane 13.

The basic block 8 of the basic housing 2 has three shafts 15 (FIG. 1), which start from a flange surface 16 and leads into one of the three cylinder bores 5 respectively, to accommodate a spark plug, an injection valve or a heater plug. For each camshaft (not shown in detail) or each valve row, four lower bearing block halves 17 are constructed in the basic housing 2, situated opposite one another in pairs.

The bucket tappet housing 3 is arranged in the interior of the basic housing 2 bounded by the exterior walls 10 to 12 and the timing case 9, and has a flange surface 18 which rests on the flange surface 16 of the basic housing 2. The two flange surfaces 16 and 18 form a common flange plane 19 and are separated from one another by an inserted seal 20. The bucket tappet housing 3 is constructed in one piece and has a center web 21 which has the flange surface 18 and with which four tappet guides 22*a* to 22*d* are connected per cylinder bore 5, which tappet guides 22*a* to 22*d* are each combined into pairs. Three bores 23, which are aligned with the shafts 15 of the basic housing 2, are constructed in the center web 21.

The cylinder head arrangement is closed off by the cylinder head cover 4 which is fitted onto the exterior walls 10 to 12 and 14. In this cylinder head cover 4, the upper bearing block halves 24 (FIG. 5) are constructed which, together with the lower bearing block halves 17 (FIG. 1) in the basic housing 2, carry the camshafts which are not shown in detail.

Figure 4:
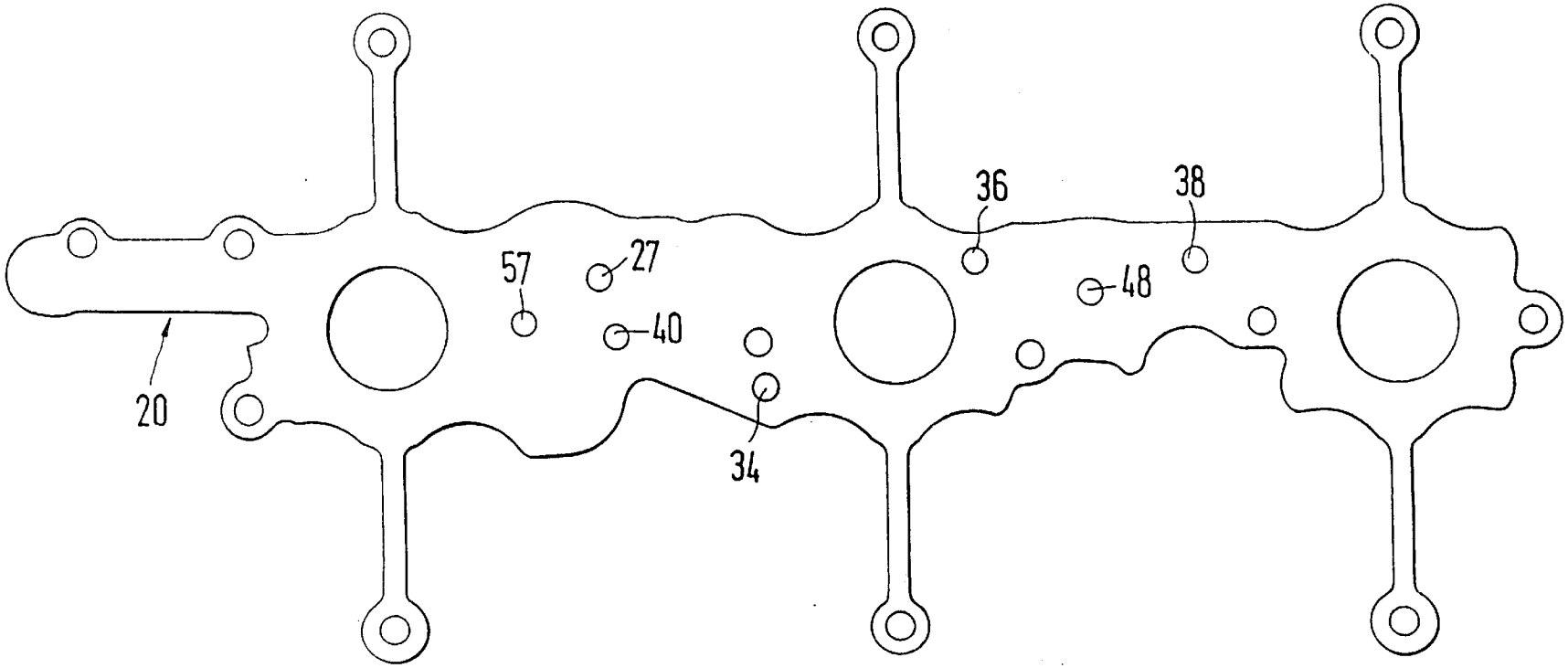
FIG. 4 is a plan view of a seal.
Figure 5:
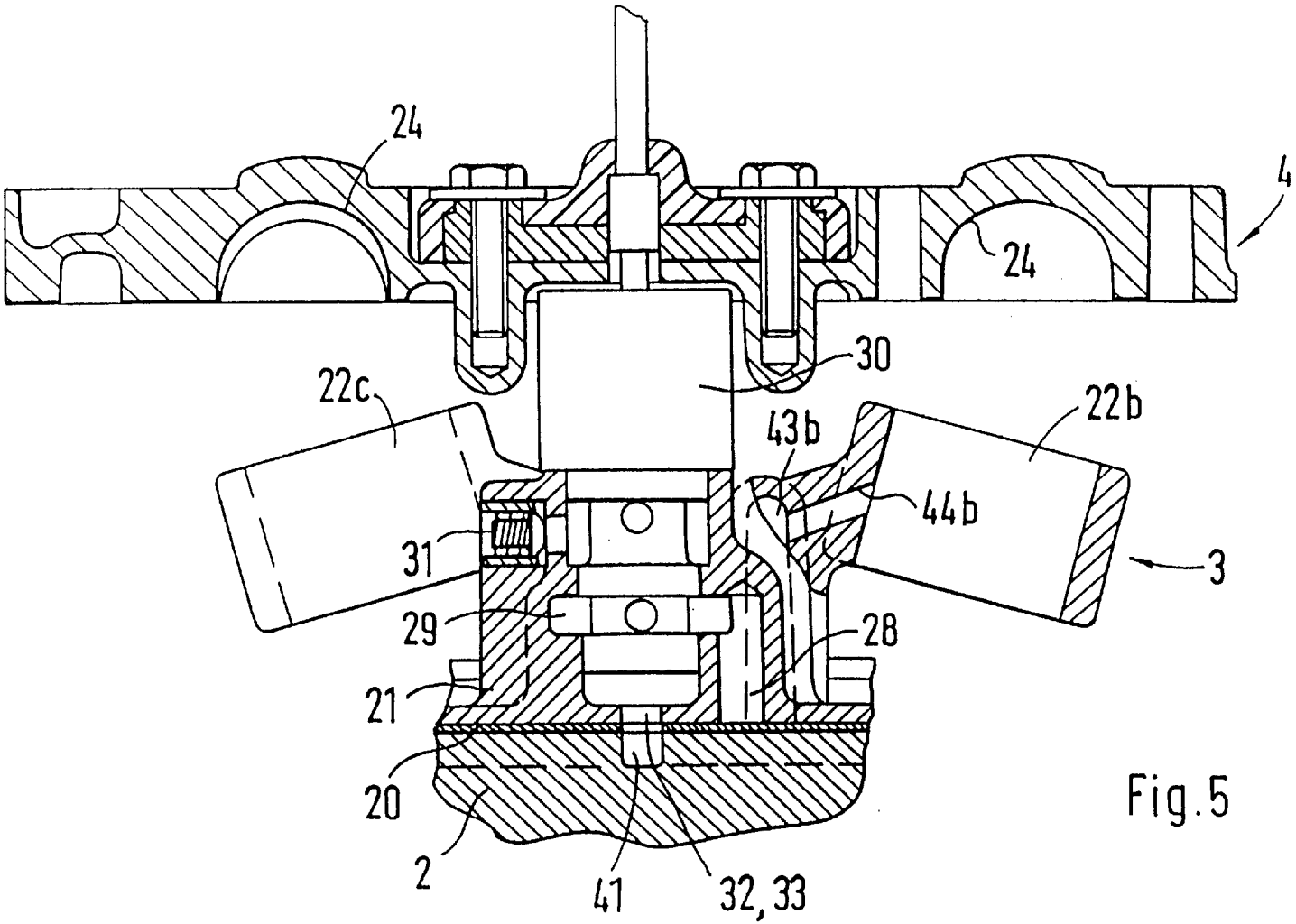
FIG. 5 is another cross-sectional view of the cylinder head arrangement along Line V—V in FIG. 1.

A pressure duct 25, illustrated by a broken line in FIG. 1, is connected with an ascending pipe of the oil supply in the cylinder block 1, in a manner not shown in detail in FIG. 1. (See FIG. 6, and discussion thereof.) This pressure duct leads into the flange surface 16 of the basic housing. A short indentation 26, which starts out from this pressure duct 25, is cast into the flange surface 16 and is connected with a pocket bore 28 (FIG. 2) in the center web 21 of the bucket tappet housing 3, by way of an opening 27 in the seal 20 (FIG. 4). This pocket bore 28 is connected via a ring bore 29 with the inlet side of a control valve 30 inserted into the center web 21 (FIG. 5). One outlet of the control valve 30 (which is also schematically shown in FIG. 6) is connected with the interior of the cylinder head arrangement, by a return valve 31. On the front side, the second outlet of the control valve 30 is connected by way of a bore 32 (FIGS. 2 and 5) with a cast-in indentation 33 in the flange surface 18 of the bucket tappet housing 3 (FIG. 2). On the other hand, this indentation 33 is connected by way of an opening 34 in the seal 20 (FIG. 4) with another indentation 35 in the flange surface 16 of the basic housing (FIG. 1). By way of another opening 36, the other end of the indentation 35 is connected with an indentation 37 in the flange surface 18, which in turn is connected with an indentation 39 in the flange surface 16, by way of a passage 38 in the seal 20 (FIG. 4). The bore 32 and an opening 40 in the seal 20 also connect the indentation 39 with an indentation 41 in the flange surface 16. The indentations 33 and 37 in the flange surface 18, as well as the indentations 35, 39 and 41 in the flange surface 16, are separated from one another by the seal 20 inserted between the two flange surfaces. Pressure medium transitions are possible only in the area of the openings 27, 34, 36, 38 and 40.

Figure 6:
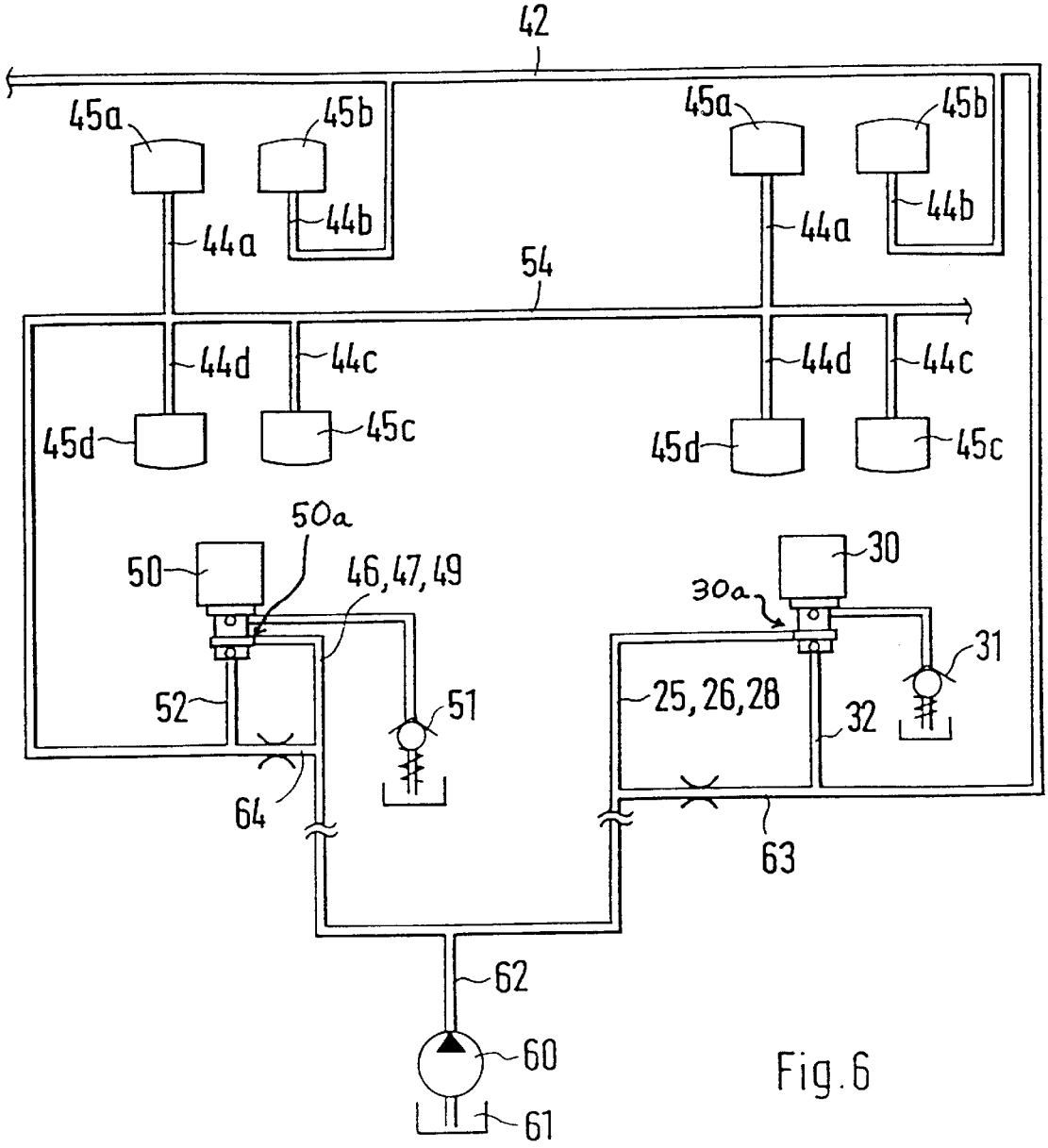
FIG. 6 is a schematic representation of the oil supply of the cylinder head.

Indentations 33 and 37, on the one hand, and 35, 39 and 41, on the other hand, together with the seal 20 and the openings 27, 34, 36, 38 and 40, therefore form a duct 42 which is connected with the control connection of the control valve 30, as shown schematically in FIG. 6. In the area of the tappet guides 22*b* of a respective cylinder, this duct 42 is connected by way of a duct 43*b* in the center web 21 (FIG. 2) and a diagonal bore 44*b* starting from it with the respective tappet guide 22*b*, and is used for the pressure medium and lubricant supply of the bucket tappets 45*b* schematically illustrated in FIG. 6. These bucket tappets can be constructed as conventional bucket tappets or as bucket tappets which can be disconnected or switched over, both of which are known per se. A disconnectable bucket tappet is a bucket tappet by means of which the valve stroke of the assigned charge cycle valve can be completely connected or disconnected. A bucket tappet which can be switched over is a bucket tappet by means of which the valve stroke of the assigned charge cycle valve can be varied in at least two steps.

A second pressure duct 46 (FIGS. 1 and 6), is connected with the oil supply in the cylinder block 1, and is also connected by way of a short indentation 47, an opening 48 in the seal 20 and a pocket bore 49) with the pressure connection of a second control valve 50 in the center web 21. This pressure duct 46 leads into the flange surface 16 of the basic housing 2. The second control valve 50, which is schematically illustrated in FIG. 6, is connected analogously to the first control valve 30, by way of a return valve 51, with the interior of the cylinder head arrangement. Analogously to the first control valve 30, the control connection is connected by way of a bore 52 (FIG. 6) with an indentation 53, which extends along almost the whole length of the flange surface 18. Three ducts 43*a*, 43*c* and 43*d* respectively lead into this indentation 53 in the area of each of the three cylinder bores 5 or of bores 23. Diagonal bores 44*a*, 44*c* and 44*d* respectively originate from these ducts in the central web 21 and supply the assigned tappet guide 22*a*, 22*c* 22*d* or the bucket tappets 45*a*, 45*c* and 45*d*. Tappet elements in a construction which can be switched over, disconnected or not switched and which are known per se can also be inserted into these tappet guides. In this case, it may be useful, for example, for the respective assigned inlet valve to be provided with a tappet element which can be disconnected or switched-over, while the assigned outlet valves are operated with tappet elements which cannot be switched.

Together with the seal 20, the indentation 53 therefore forms a duct 54 (FIG. 6) which is connected with the control connection of the second control valve 50. This duct 54, together with the ducts 43*a*, 43*c* and 43*d* as well as the diagonal bores 44*a*, 44*c* and 44*d*, is used to supply pressure medium and lubricant to the tappet guides 22*a*, 22*c* and 22*d* or to the bucket tappets 45*a*, 45*c* and 45*d*.

A bore 55 (FIG. 2) connects the ring duct 29 (FIG. 5) on the first control valve 30 with a short indentation 56 in the flange surface 18 (FIG. 2). This indentation 56, in turn, is connected by way of an opening 57 in the seal 20 (FIG. 4) with an indentation 58 (FIGS. 1 and 3) in the flange surface which leads into the area of the timing case 9. A third duct 59 (FIG. 2) formed by this indentation 58 cooperates with the seal 20, to supply oil to front-side constructional elements which, in this embodiment, are arranged in the area of the timing case. These may, for example, be hydraulically actuated chain tensioners of the control drive. By way of this duct section, it is also possible to actuate arrangements for changing the phase position of the camshafts (camshaft phase adjusters).

The oil supply of the cylinder head arrangement is illustrated schematically in FIG. 6 for four bucket tappets 45*a* to 45*d* (stroke transmitting elements) for each of two cylinders. In this example, the bucket tappets 45*a* and 45*b* are each switchable elements (stroke switch-over or disconnection of stroke), while the bucket tappets 45*c* and 45*d* assigned to the outlet valves are not switchable. The oil pump 60 of the internal-combustion engine conveys oil from the oil pan 61 of the internal-combustion engine, through an ascending pipe 62 in the cylinder block 1, into the cylinder head arrangement. There, the input sides 30*a*, 50*a* of the two control valves 30, 50 are acted upon by pressure, as described above. In the unswitched condition, the input side of each control valve is connected with the return valve 31 or 51, which are designed such that they do not open before a given pressure is exceeded. This opening pressure is lower than the control pressure of the bucket tappets or of the control elements integrated into the circulation. These arrangements, together with the respective throttle lines 63 and 64 between the ascending pipe 62 and the duct 42 or 54, thus ensure that the pressure does not fall below that which is required for the lubrication within the cylinder head arrangement. In the switched condition, the inlet side 30*a*, 50*a* of the respective control valves 30, 50 are connected with the control connection or the bore 32 and 52. Thus, in the switched condition, the respective assigned duct 42 and 54 is acted upon by the feed pressure of the oil pump 60, permitting a switch-over of the assigned switchable bucket tappets (stroke transmitting elements).

In contrast to the embodiment illustrated here, the independent duct sections or ducts constructed in the flange plane 19 permit the supply of pressure medium and lubricant not only to the bucket tappet elements in their respective embodiment, but also to other consumers within the cylinder head arrangement. These may, for example, be all lubricating points within the range of the valve drive. By the separation of the individual ducts or duct sections, it is also possible to supply different consuming devices with a pressure medium or lubricant. In particular, these may be switchable valve transmission elements, such as drag levers, rocker levers or the like.

As an alternative or supplementary manner, it is also possible to supply pressure to the valve phase adjusting elements by way of one of these ducts or duct sections. On the whole, the arrangement of different ducts and duct sections within the flange plane or within the flange surfaces separated from one another by the seal, offers the possibility of supplying different consuming devices with a lubricant or a pressure medium independently of one another.

In contrast to the embodiment illustrated here, it is also possible in this case to supply lubricating oil supply and to control the pressure of switchable consuming devices (for example, switchable valve stroke transmitting elements) mutually independently by the separate admission by way of separate ducts or pipes. In this case, this consuming device is supplied with lubricating oil via first pipes. Through these first pipes, for example, hydraulic valve play compensating elements can then also be acted upon, while a second pipe permits control of the pressure for switching elements. These pipes are then connected, for example, with one of the ducts respectively so that the pressure and the volume flow can be adapted mutually independently to the different requirements.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cylinder head arrangement for an internal-combustion engine, said cylinder head arrangement comprising:

at least first and second housing components having flange surfaces which adjoin a common flange plane;

a seal separating said first and second housing components in said common flange plane; and at least two oil supply ducts which are separated from one another by said seal;

a first oil supply duct being formed between the seal and the first housing component; and a second oil supply duct being formed between the seal and the second housing component.

2. Cylinder head arrangement according to claim 1 wherein:

at least one of said first and second oil supply ducts comprises a plurality of segments; and the seal has at least one passage through which segments of said at least one of said first and second oil supply ducts are connected with one another.

3. Cylinder head arrangement according to claim 1 wherein one of the housing components is a basic housing which has charge cycle ducts and valve guides and is fitted onto a cylinder block.

4. Cylinder head arrangement according to claim 2 wherein one of the housing components is a basic housing which has charge cycle ducts and valve guides and is fitted onto a cylinder block.

5. Cylinder head arrangement according to claim 1 wherein the ducts are formed at least in sections by cast-in indentations in the flange surfaces of the respective housing component.

6. Cylinder head arrangement according to claim 2 wherein the ducts are formed at least in sections by cast-in indentations in the flange surfaces of the respective housing component.

7. Cylinder head arrangement according to claim 1 further comprising at least two consuming devices which are supplied with oil independently of one another, via said at least two oil supply ducts.

8. Cylinder head arrangement according to claim 2 further comprising at least two consuming devices which are supplied with oil independently of one another, via said at least two oil supply ducts.

9. Cylinder head arrangement according to claim 5 further comprising at least two consuming devices which are supplied with oil independently of one another, via said at least two oil supply ducts.

10. Cylinder head arrangement according to claim 7 wherein at least one of the oil supply ducts is connected with a control valve by means of which in each case at least one controllable consuming device is supplied within the cylinder head arrangement.

11. Cylinder head arrangement according to claim 7 wherein the controllable consuming device is a hydraulically controllable element for changing the valve stroke.

12. A cylinder head arrangement for an internal combustion engine, said cylinder head arrangement comprising:

at least first and second housing components having flange surfaces which adjoin a common flange plane;

a seal separating said first and second housing components in said common flange plane; and at least two separate oil supply ducts which are formed between said seal and said respective flange surfaces of said first and second housing components, and are separated from one another by said seal;

at least one of said oil supply ducts comprising a plurality of segments formed consecutively oil opposite sides of said seal.

13. Cylinder head arrangement according to claim 12 wherein:

said oil ducts are formed by indentations in said flange surfaces of said first and second housing components, adjacent said seal; and said consecutive segments of said at least one of said oil supply ducts are connected via openings in said seal.

14. Cylinder head arrangement according to claim 13, wherein at least one of said at least two oil supply ducts is connected with an oil pressure supply via openings in said seal.

15. Cylinder head arrangement according to claim 13 wherein at least one of said at least two oil supply ducts is connected to supply oil to at least one consuming device via an opening in said seal.

16. Cylinder head arrangement according to claim 12 wherein one of the housing components is a basic housing which has charge cycle ducts and valve guides and is fitted onto a cylinder block.

17. Cylinder head arrangement according to claim 12 further comprising at least two consuming devices which are supplied with oil independently of one another, via said at least two oil supply ducts.

18. Cylinder head arrangement according to claim 12 wherein at least one of the oil supply ducts is connected with a control valve by means of which in each case at least one controllable consuming device is supplied within the cylinder head arrangement.

19. Cylinder head arrangement according to claim 13 wherein at least one of the oil supply ducts is connected with a control valve by means of which in each case at least one controllable consuming device is supplied within the cylinder head arrangement.

20. Cylinder head arrangement according to claim 17 wherein the controllable consuming devices is a hydraulically controllable element for changing the valve stroke.

* * * * *